US010652668B2

(12) United States Patent
Rosenkranz et al.

(10) Patent No.: US 10,652,668 B2
(45) Date of Patent: May 12, 2020

(54) METHOD AND HEARING AID FOR THE FREQUENCY DISTORTION OF AN AUDIO SIGNAL

(71) Applicant: SIVANTOS PTE. LTD., Singapore (SG)

(72) Inventors: Tobias Daniel Rosenkranz, Erlangen (DE); Tobias Wurzbacher, Fuerth (DE); Christos Oreinos, Nuremburg (DE)

(73) Assignee: Sivantos Pte. Ltd., Singapore (SG)

( * ) Notice: Subject to any disclaimer, the term of this patent is extended or adjusted under 35 U.S.C. 154(b) by 116 days.

(21) Appl. No.: 15/867,980

(22) Filed: Jan. 11, 2018

(65) Prior Publication Data

US 2018/0199141 A1 Jul. 12, 2018

(30) Foreign Application Priority Data

Jan. 11, 2017 (DE) ..... 10 2017 200 320

(51) Int. Cl.
*H04R 25/00* (2006.01)
*G10L 25/18* (2013.01)
*H04R 3/02* (2006.01)

(52) U.S. Cl.
CPC ..... *H04R 25/453* (2013.01); *G10L 25/18* (2013.01); *H04R 3/02* (2013.01); *H04R 25/353* (2013.01)

(58) Field of Classification Search
CPC ..... H04R 25/453; H04R 3/02; H04R 25/353; G10L 25/18
USPC ..... 381/318
See application file for complete search history.

(56) References Cited

U.S. PATENT DOCUMENTS 4,000,676 A * 1/1977 Love ..... G10H 1/043 84/706
5,184,219 A * 2/1993 Cho ..... H04N 7/087 375/240.01
7,907,678 B2 * 3/2011 Mizuta ..... H03F 1/3258 330/149
8,326,638 B2 * 12/2012 Tammi ..... G10L 19/0208 704/500
8,411,885 B2 * 4/2013 Kornagel ..... H04R 25/453 381/312
8,538,053 B2 * 9/2013 Puder ..... H04R 25/453 381/316
2002/0044597 A1 * 4/2002 Shively ..... H04L 27/2608 375/222
2003/0022650 A1 * 1/2003 Tsuji ..... H04B 1/1081 455/296

(Continued)

FOREIGN PATENT DOCUMENTS

DE 102009018812 A1 11/2010
DE 102010006154 A1 8/2011

(Continued)

*Primary Examiner* — Oyesola C Ojo
(74) *Attorney, Agent, or Firm* — Laurence A. Greenberg; Werner H. Stemer; Ralph E. Locher

(57) ABSTRACT

A method performs frequency distortion of an audio signal. The audio signal is divided at at least one division frequency into a low-frequency band and a high-frequency band. A frequency-distorted signal is generated through respectively different distortions of frequencies for the high-frequency band and for the low-frequency band. The division frequency is selected such that it is located between two neighboring tones of a given tonal system.

13 Claims, 2 Drawing Sheets

(56) References Cited

U.S. PATENT DOCUMENTS

| | | | | |
|---|---|---|---|---|
| 2006/0262880 | A1* | 11/2006 | Mizuta | H03F 1/3258 375/297 |
| 2010/0272289 | A1* | 10/2010 | Kornagel | H04R 25/453 381/94.3 |
| 2010/0290631 | A1* | 11/2010 | Petrausch | H04R 25/353 381/23.1 |
| 2011/0194714 | A1* | 8/2011 | Puder | H04R 25/353 381/318 |
| 2012/0250918 | A1 | 10/2012 | Pape et al. | |
| 2012/0306631 | A1* | 12/2012 | Hughes | G09B 21/009 340/407.1 |

FOREIGN PATENT DOCUMENTS

| | | | |
|---|---|---|---|
| DE | 102011006515 | A1 | 10/2012 |
| JP | 2016143028 | A | 8/2016 |

* cited by examiner

METHOD AND HEARING AID FOR THE FREQUENCY DISTORTION OF AN AUDIO SIGNAL

CROSS-REFERENCE TO RELATED APPLICATION

This application claims the benefit, under 35 U.S.C. § 119, of German patent application DE 10 2017 200 320.0, filed Jan. 11, 2017; the prior application is herewith incorporated by reference in its entirety.

BACKGROUND OF THE INVENTION

Field of the Invention

The invention relates to a method for the frequency distortion of an audio signal, wherein at least one division frequency is selected. The audio signal is divided at the at least one division frequency into a low-frequency and a high-frequency band. An output signal is generated through respectively different distortions of frequencies for the high-frequency band and for the low-frequency band.

The control of an acoustic feedback often plays a central role for the operation of acoustic systems with which sound signals in the broadest sense from the environment are reproduced in electrically amplified form, including for example hearing aids. The acoustic feedback can occur in these cases when an output sound signal generated by the acoustic system is partially coupled into an input transducer of the acoustic system which is provided to pick up the sound signal from the environment and for the corresponding generation of an electrical input signal. In this case, signal bands of the output sound signal can be electrically amplified again by the acoustic system, so that as a result interfering noise is formed in the output sound signal which can fully overlay possible useful signals in the sound signal of the environment, to the extent that they are entirely unable to be heard. A suppression or compensation of an acoustic feedback can therefore be provided in the electrical signal path of the acoustic system. Compensation of this sort is often implemented by an adaptive filter to which the finished, amplified output signal, from which the output sound signal is generated, is supplied as an input magnitude, and from this a compensation signal is generated which is fed back to the as yet unamplified input signal for compensation of the feedback. The adaptive filter is usually controlled here by an error signal which is formed from the difference between the input signal and the compensation signal.

If the sound signal of the environment that is to be electrically amplified by the acoustic system now consists of a pure sinusoidal tone with a fixed frequency, then the compensation signal generated by the adaptive filter on the basis of the amplified output signal is also a sinusoidal signal of the same frequency as the sound signal of the environment, and is thus the same as the input signal. With a subtraction in the correct phase, the compensation signal which is actually provided to suppress an acoustic feedback therefore fully cancels out the input signal. This consideration shows that, in general, for sound signals with a high proportion of tonal signals, cancellations or artifacts in the output signal can be generated by the adaptive filter signal, and these should preferably be avoided.

For this purpose, the output signal in the acoustic system is often subjected after amplification to a frequency distortion, whereby the output signal is decorrelated from the input signal, so that the occurrence of the signal cancellation described above can largely be avoided. Depending on the nature of the sound signal of the environment, the frequency distortion is usually only applied to a specific frequency range of the amplified signal, for which purpose the latter is filtered at a given division frequency into a signal band that is to be distorted and a signal band that is not to be distorted. Due to the finite edge gradient of the filter applied for this purpose, overlaps between frequency-distorted signal bands and non-frequency-distorted signal bands can arise in the output signal in the region of the division frequency which can be experienced as unwanted or unpleasant in the output sound signal generated by the acoustic system. For sound signals with a high tonal proportion in particular, i.e. precisely in the case for which it is preferred to apply a frequency distortion for effective suppression of an acoustic feedback without artifacts, these kinds of overlaps can have particularly negative effects on the auditory experience of the output signal, in particular when one of the tonal components of the sound signal coincides with the division frequency.

SUMMARY OF THE INVENTION

The invention is therefore based on the object of providing a method for frequency distortion of an audio signal which minimizes to the greatest possible extent unpleasant effects from the overlap of frequency-distorted signal bands with non-frequency-distorted signal bands.

The object is achieved according to the invention by a method for frequency distortion of an audio signal wherein the audio signal is divided at at least one division frequency into a low-frequency band and a high-frequency band. A frequency-distorted signal is generated through respectively different distortions of frequencies for the high-frequency band and for the low-frequency band, and the division frequency is selected such that it is located between two neighboring tones of a given tonal system. Advantageous embodiments, to some extent inventive in themselves, are objects of the subsidiary claims and the following description.

In particular here, either only the high-frequency band is frequency-distorted, without changing frequencies of the low-frequency band in the process, or only the low-frequency band is frequency-distorted, without changing frequencies of the high-frequency band in the process. In both cases, the resulting frequency-distorted signal then contains both frequency-distorted signal bands and signal bands whose frequencies have not been distorted. Preferably, moreover, the division frequency is selected so as to maintain a specified minimum distance, in absolute values or in terms of the frequency ratio, from each of the frequencies of the two neighboring tones of the given tonal system. A frequency distortion contains, in particular, a frequency shift, wherein the value of the shift may in appropriate cases depend on the frequency of the audio signal concerned, or, however, can remain constant over the individual frequencies to which the shift is applied.

The problems that can arise for a further processing of frequency-distorted audio signals at a division frequency between regions of different frequency distortion, and therefore in particular for an auditory experience of an output signal whose processing is complete, depend to a significant extent on the proportion of tonal components in the audio signal whose frequency is to be distorted. As a consequence of the finite edge gradient of the filter which is to be used to provide the signal bands at the division frequency, and of the finite overlap of the signal bands resulting from that, to which the respectively different frequency distortions are to be applied, the frequency distortion of a clearly defined tonal component that is the same as the division frequency, or which lies in the overlap region described, can lead to an audible overlap of the differently frequency-distorted signal bands in the output signal which in the end originate from the same tonal components.

In usual applications of frequency distortions, the individual frequencies of the audio signal are only changed by a relatively small amount in relation to the respective output frequency by the distortion, so that an output signal generated from the frequency-distorted audio signal still permits an auditory experience of the acoustic information of the original audio signal that is as true as possible to the original. In the case of the overlaps described above of the differently frequency-distorted signal bands of the same tonal components, this now leads to overlaps with a relatively small frequency spacing, which in the case of pure frequency shifts for frequency distortion leads to beat frequencies with varying amplitudes, which otherwise in the case of non-trivial frequency-dependent distortions can be expressed in clattering or rattling interfering noises.

In an advantageous manner, the circumstance that the tonal components, i.e. local spectrum maxima of the concentration of signal energy, often do not occur randomly, is now exploited by the invention. Whereas, for example, the tonal components of spoken language are usually of relatively short duration, and in addition do not necessarily exhibit regularly recurring frequency patterns, recurring tonal components with stable frequencies are mostly associated with a musical sound. Music is in this respect usually characterized in that the majority of sound events are composed of tonal sound signals which, in comparison with other sound sources such as for example speech, exhibit a stationary or quasi-stationary behavior, in which the frequencies of the tones can be found from a clearly defined frequency pattern, that of the tonal system on which the music is based. With the knowledge of the tonal systems usual for music, it is now possible, in order to avoid the problems with the tonal sound signals of music described above, for a division frequency to be selected so as to lie between two frequencies that are adjacent in a given tonal system, and preferably here to be sufficiently distant from the frequencies concerned that the overlap at the division frequency has no effect on the subsequent frequency distortion of the individual tonal components that correspond to tones in the tonal system.

For a determination of the distance of the division frequency from the two neighboring frequencies in the tonal system, the edge gradient of the filter to be used for the division of the audio signal and/or a spectral range that is to be expected of the tonal components of the tonal system, and/or a possible deviation of the concrete implementation of the tonal system that is to be expected from the exact frequencies are preferably to be employed, for example through systematically shifting the tonal system when tuning.

Favorably the tonal system is given by a division of an octave, based on a predetermined reference tone, into twelve tonal steps, each with the same frequency ratio $$\sqrt[12]{2}.$$

This corresponds to the equal tempering of the octave. As a result of the psychoacoustic perception of an octave—i.e. two tones with a frequency ratio of 2:1—as being the "same" or at least "similar" tones, a tonal system for the whole audible frequency spectrum is given in this way. Preferably the concert pitch with $a^1$ at 440 Hz is to be chosen here as the reference tone, although an equally tempered tuning with a different reference tone is also possible, e.g. a specification of $a^1$=430.539 Hz (which corresponds to choosing $c^1$ to be 256 Hz). In particular, the possibility of alternative reference tones ($a^1$=442 Hz, for example) with the minimum spacing to be maintained between the division frequency and the frequencies of the tones of the tonal system—defined in absolute values or according to the frequency ratio—can be taken into account. In addition, this minimum distance to be maintained can also be determined depending on deviations from the exact frequencies of the tonal system which result from the use of pure or perfect fifth (so-called "Pythagorean") intervals. Individual musical instruments, such as brass instruments which are particularly used in orchestral music and in jazz, and which therefore contribute significantly to the character of the sound image of such music, generate tone sequences of pure intervals above particular basic tones, containing, for example, pure fourths or also pure thirds. Other musical instruments, in particular string instruments such as the bowed strings that characterize the sound of orchestral music, or the guitars that characterize the sound of modern rock music are tuned in series of fifths. Both tuning by series of fifths with respect to a base tone and the use of pure intervals above the base tone lead to deviations from the equally tempered frequency ratio.

Preferably, therefore, within the framework of the equally tempered tonal system which divides the octave into 12 equal semitone steps with a frequency ratio $$\sqrt[12]{2},$$

a frequency corridor is specified between the individual tones, from which the division frequency can be selected, wherein the frequency corridor takes into account different tunings such as, for example, a selection of the reference tone as $a^1$=442 Hz, as well as the sequence of pure and perfect fifth intonation from certain musical instruments.

Favorably only the frequencies of the high-frequency band or only those of the low-frequency band are shifted by a constant amount for the distortion. A frequency shift of this sort of only one of the two frequency bands at the division frequency can, on the one hand, be implemented particularly easily and, on the other hand, has the consequence that, not least as a result of the unchanged reproduction of one of the two frequency bands, the auditory experience of an output signal derived from the frequency-distorted signal comes particularly close to a non-frequency-distorted signal, with the exception of possible problems at the division frequency. The proposed method now contributes to overcoming these problems, and to clearing the auditory experience of audible effects of the frequency distortion, even in the immediate vicinity of the division frequency.

It is further found to be advantageous if the division frequency is selected from a frequency interval that is located between the frequencies of two neighboring tones of the tonal system in such a way that the lowest frequency and the highest frequency of the frequency interval are equidistant, or logarithmically equidistant, from the frequencies of the two neighboring tones. Equidistant positioning of the lowest frequency and the highest frequency of the frequency interval between the frequencies of the two neighboring tones is to be understood here to mean that each adjacent pair of the four said frequencies—i.e. the two neighboring tones of the tonal system and the two limits of the frequency interval—have the same distance from one another. A logarithmic equidistance is accordingly to be understood to mean that the logarithms of each neighboring pair of the four frequencies have the same distance from one another, and thus the two neighboring frequencies exhibit the same frequency ratio. A selection of the division frequency of this sort supplies a frequency corridor which in particular takes adequate account of real implementations of the tonal system that deviate from the theoretical ideal.

Favorably here the division frequency is selected as the geometric mean value of the frequencies of the two neighboring tones. As a result, the frequency ratio of the division frequency to the frequencies of the two neighboring tones—in the ascending direction—is the same, and thus also the distance in the tonal system, which makes the behavior of the frequency-distorted signal at the division frequency particularly robust against non-ideal implementations, for example detunings, of the tonal system.

In one favorable embodiment, a frequency profile of the audio signal is determined, wherein the division frequency is selected such that the audio signal exhibits a lowest possible signal energy at the division frequency. One possible criterion for the signal energy can then, for example, be a local minimum of the signal energy, or can be defined as an attenuation with respect to the total maximum value of the signal energy, for example, an upper limit of 10% of the maximum value of the signal energy over the entire audible spectrum. With respect to the signal energy, a range can, for example, be determined, from which the division frequency is advantageously to be selected, wherein the selection is associated with the additional boundary conditions that are given, in the manner described above, by the tonal system.

It is furthermore found to be advantageous if a value for a tonality of the audio signal is determined, and the division frequency is only then selected such that it is located between two neighboring tones of the given tonal system if the value for the tonality exceeds a predetermined limit value. This procedure makes it possible that for audio signals that do not exhibit a significant tonal signal proportion, the division frequency is specified directly, without further restrictions from the tonal system, in a manner as required by a high-level specification—for example, an optimum suppression of a feedback in an acoustic system. The definition usual in psychoacoustics can be employed here in particular to find the value for tonality, and/or a stationarity of the audio signal —for example making use of a temporal mean value—can also be taken into account.

The invention furthermore discloses a method for the suppression of an acoustic feedback in an acoustic system. An input transducer of the acoustic system generates an input signal from a sound signal of the environment and an intermediate signal is generated by a signal processing unit on the basis of the input signal. An output signal is generated from a frequency-distorted signal which is converted into an output sound signal by an output transducer of the acoustic system and on the basis of the frequency-distorted signal, an acoustic feedback occurring in the acoustic system through coupling the output sound signal into the input transducer is suppressed. The method for frequency distortion described above is applied to the intermediate signal and thereby the frequency-distorted signal is generated. Preferably the suppression of the acoustic feedback is achieved through a signal-technology feedback loop in the acoustic system which receives the frequency-distorted signal, amongst other things, as the input variable and outputs a compensation signal for the input signal as its output variable. A hearing aid in particular, as well as systems for recording, amplifying and replaying sound signals from studio and/or stage technology are included here as acoustic systems.

Generally speaking, an input transducer contains an acoustic-electrical converter that is configured to convert the sound signal of the environment into a corresponding electrical or electromagnetic signal, i.e. for example a microphone. An output transducer generally contains an electroacoustic converter that is configured to generate an output sound signal from an electrical and/or electromagnetic signal, i.e. for example a loudspeaker or a sound source for bone-conducted sound. Signal processing here particularly refers to a processing of the input signal or of a signal derived from the input signal, i.e. in particular a frequency-band-dependent amplification and/or noise suppression.

A generation of the intermediate signal on the basis of the input signal here refers in particular to the fact that the signal processing unit directly receives the input signal as the input variable, and generates the intermediate signal from this, or that the signal processing unit receives a signal directly depending on the input signal and generates the intermediate signal from this, i.e. for example the input signal which is corrected by a compensation signal to compensate for an acoustic feedback.

The advantages quoted for the method for frequency distortion of an audio signal and its developments can analogously be transferred to the method for the suppression of an acoustic feedback in an acoustic system.

It is here found to be further advantageous if a provisional division frequency is selected, wherein an estimation of a transfer function of the acoustic system for the high-frequency band in the region of the provisional division frequency is made, wherein, when the estimated transfer function exceeds a permissible total amplification, the at least one division frequency is selected below the provisional division frequency. The frequency-distorted signal is generated through a distortion of frequencies of only the high-frequency band, and the provisional division frequency is selected such that it lies between two neighboring tones of the given tonal system. In particular here only the high-frequency band of the frequency-distorted signal is used for a compensation signal that is added to the input signal for suppression of the acoustic feedback, so that the suppression of the acoustic feedback only takes place in the region of the high-frequency band. In this way only a restricted frequency range is exposed to a possible auditory impairment through the suppression of the feedback, which is determined according to the conditions resulting from the tonal system, in order to avoid as far as possible impairments to the sound quality at the transition to this range.

The invention furthermore discloses a hearing aid containing an input transducer for the generation of an input signal from a sound signal of the environment, a signal processing unit for the generation of an audio signal on the basis of the input signal, and a frequency distorter, which is configured to carry out the above-described method for the frequency distortion of an audio signal. The advantages described for the method and for its development can here be analogously transferred to the hearing aid. In particular, the signal processing unit and the frequency distorter are each parts of a common control unit; in this case, the audio signal is an intermediate signal in the control unit.

Other features which are considered as characteristic for the invention are set forth in the appended claims.

Although the invention is illustrated and described herein as embodied in a method for the frequency distortion of an audio signal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts and values that correspond to one another are each given the same reference signs in all the figures.

Figure 1:
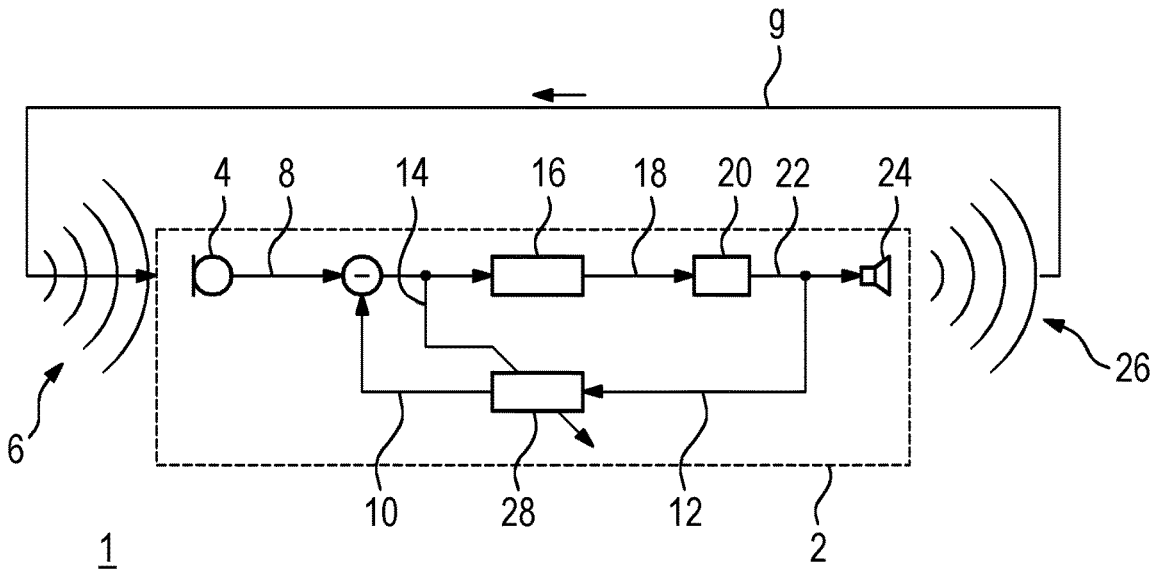
FIG. 1 is a block diagram for explaining a method for suppression of acoustic feedback in a hearing aid according to the invention.

Referring now to the figures of the drawings in detail and first, particularly to FIG. 1 thereof, there is shown schematically in a block diagram a method 1 for the suppression of acoustic feedback g in an acoustic system. The acoustic system here is given by a hearing aid 2. The hearing aid 2 has an input transducer 4 which generates an input signal 8 from a sound signal 6 of the environment, and in the present case is given by a microphone. A compensation signal 10, which is generated in a manner yet to be described in an electrical feedback loop 12, is subtracted from the input signal 8. An error signal 14 that results from the input signal 8 and the compensation signal 10 is supplied to a signal processing unit 16, in which the user-specific signal processing for the hearing aid 2 takes place, i.e. in particular a frequency band-dependent amplification of the error signal 14. The signal processing unit 16 now outputs an amplified audio signal 18, to which a frequency distortion 20 is applied. The output signal 22 resulting from the frequency distortion 20 is on the one hand converted by an output transducer 24 into an output drive signal 26. The output transducer 24 is given in the present case by a loudspeaker.

On the other hand the output signal 22 is diverted to the electrical feedback loop 12, where it is fed to an adaptive filter 28 which also receives the error signal 14 as a further input value, and from these generates the compensation signal 10 for the suppression of the acoustic feedback g. Through the frequency distortion 20, the output signal 22 is decorrelated from the input signal 8, and thus also from the error signal 14, so that through the renewed input of the error signal 14 into the adaptive filter 28, the latter is not fully adapted to the tonal signal components of the output signal 22. In this way the formation of artifacts in the output signal 22, and thus in the output sound signal 26, can be avoided. The suppression of the acoustic feedback g by the compensation signal 10 can here in particular remain restricted to specific frequency ranges, i.e. the compensation signal 10 in this case only contains significant signal components for the frequency bands.

Figure 2:
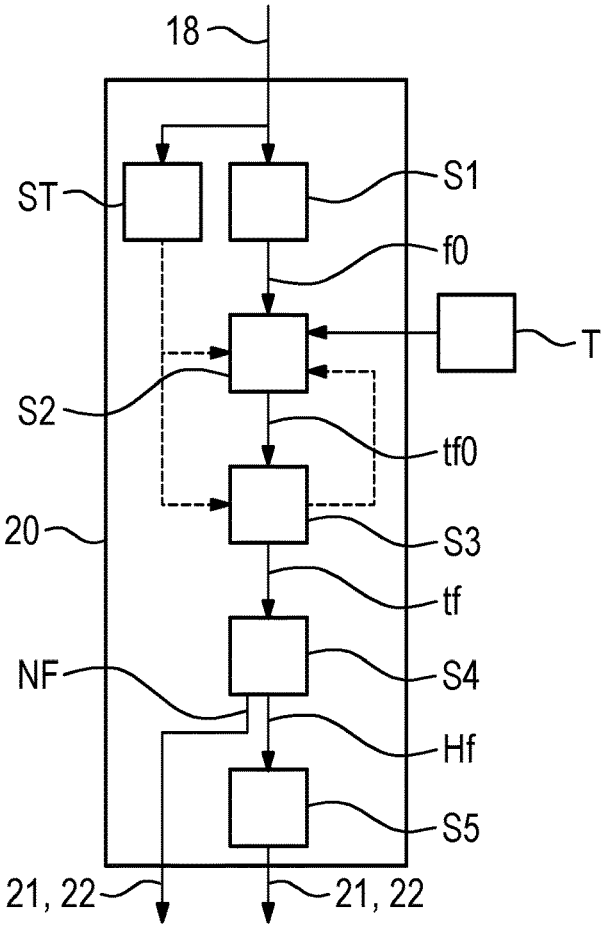
FIG. 2 is a block diagram for explaining a method for the frequency distortion of an audio signal.

In FIG. 2 a method for the frequency distortion 20 of an audio signal is illustrated schematically in a block diagram. The audio signal is given here by the amplified audio signal 18 in the hearing aid 2 according to FIG. 1. In a first step S1, a frequency f0 is first specified as a possible division frequency on the basis of the requirements in the hearing aid 2, which can, for example, be given in order to be able to suppress the acoustic feedback g effectively and without artifacts. In a second step S2, the possible division frequency f0 is embedded into a tonal system T such that a provisional division frequency tf0 is generated. The provisional division frequency tf0 can here, for example, be generated as the geometric mean value of the two frequencies of neighboring tones of the tonal system T between which the possible division frequency f0 lies. In a next step S3, the suitability of the provisional division frequency tf0 for the frequency distortion 20 is examined. This can, for example, be done in that in the region of the provisional division frequency tf0 a transfer function of the hearing aid 2 and/or a total amplification of the closed loop consisting of the hearing aid 2 and the acoustic feedback g is estimated. In some cases, in the absence of the suitability, the provisional division frequency tf0 can be placed between two different neighboring tones of the tonal system T, so that the examination of step S3 is carried out again.

When, following iteration if necessary, the examination S3 indicates a suitability of the provisional division frequency tf0 for the suppression of the acoustic feedback g, the provisional division frequency tf0 is output as the division frequency tf, and the audio signal 18 is divided in a step S4 at the division frequency tf into a high-frequency band HF and a low-frequency band NF. In a step S5, the high-frequency band HF is now shifted in frequency by a constant amount, while the low-frequency band NF is retained. The frequency-distorted signal 21, which forms the output signal 22 in the hearing aid, now results from this. A tonality in the audio signal 18 can optionally be determined in a step ST, and the execution of steps S2 and S3, i.e. the adaptation of the division frequency tf between two neighboring tones of the tonal system T, takes place depending on the tonality of the audio signal 18 determined in step ST.

Figure 3:
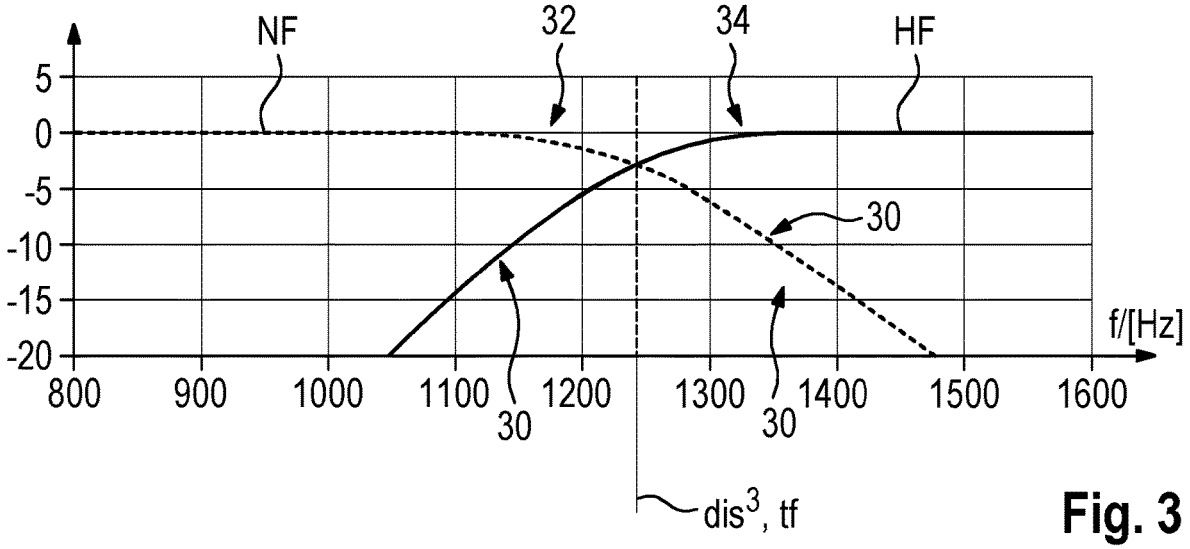
FIG. 3 is a graph showing a frequency profile of a filter which is configured to divide an audio signal at a division frequency into a low-frequency band and a high-frequency band.

In FIG. 3, the frequency profile of a filter is shown on a diagram depending on a frequency f, which divides the audio signal 18 according to FIG. 2 at the division frequency tf into a high-frequency band HF and a low-frequency band NF. In the present case, the division frequency tf is selected at the tone $d\#^3$=approximately 1245 Hz. Due to the finite gradient of the edges 30, there is a finite overlap of the low-frequency band NF with the high-frequency band HF, where the attenuation of the high-frequency band HF in the region 32 immediately below the division frequency tf and the attenuation of the low-frequency band NF in the region 34 immediately above the division frequency tf are both about 3 dB, where at the division frequency the low-frequency band NF and the high-frequency band HF are output from the filter with the same strength. Often a stronger attenuation by the filter is unwanted or not feasible due to the resulting higher latency times. This therefore means that the $d\#^3$ tone in the audio signal, located almost exactly at the division frequency, following a subsequent frequency shift of the high-frequency band HF by, for example, in 11 Hz, makes its way into the output signal on the one hand with its correct pitch, and on the other hand, through the almost identical attenuation of only 3 dB of the high-frequency band, also as a tone shifted through 11 Hz at 1256 Hz. This causes a beat frequency in the output signal which, amongst other consequences, also results in a heavy oscillation of the amplitude envelopes. The perception of the volume of the resulting tone is also subject to this oscillation: the tone begins to "rattle".

Figure 4:
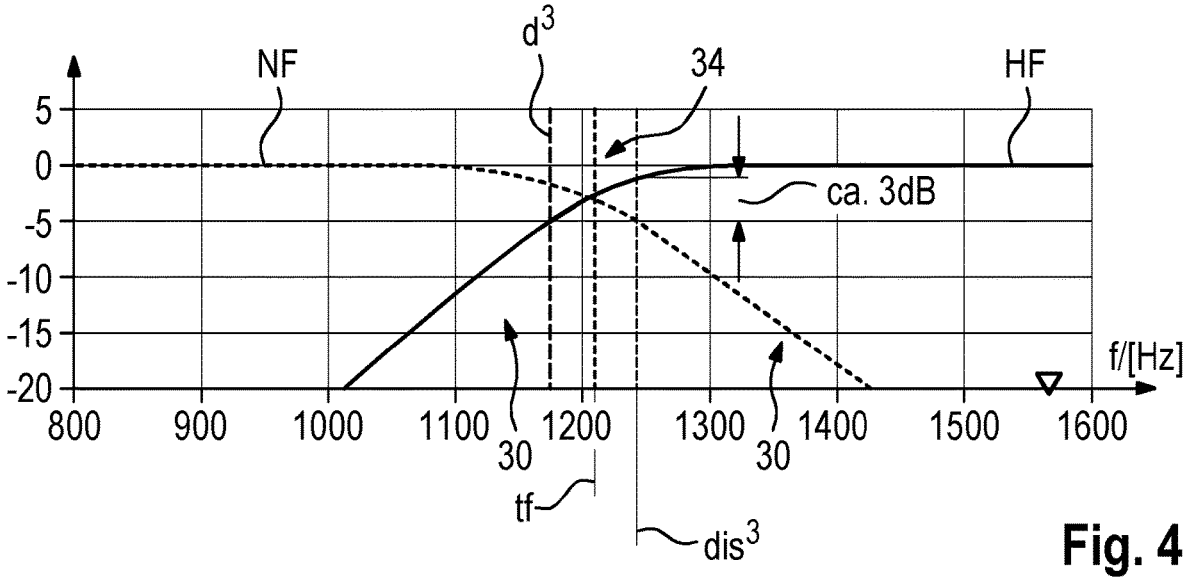
FIG. 4 is a graph showing the frequency profile of the filter according to FIG. 3 with a division frequency selected between two tonal signal components.

A diagram of the frequency profile of the filter according to FIG. 3 is illustrated in FIG. 4, wherein now, however, the division frequency tf is select precisely at the geometrical mean value between the frequencies of the tones $d^3$ (about 1175 Hz) and $d\#^3$ (about 1245 Hz), i.e. at tf=1209 Hz. This selection for the division frequency corresponds precisely to a quarter-tone spacing from $d^3$ and $d\#^3$. If the high-frequency band is then frequency-shifted, e.g. again by 11 Hz, then in this case at a tone $d\#^3$ in the audio signal 18 of the low-frequency band NF in the region 34 at the division frequency tf is no longer output with the same amplitude as the high-frequency band HF, but is attenuated with respect to that by about 3 dB. This has the consequence that a signal component of the tone $d\#^3$ in the audio signal 18 now finds its way into the high-frequency band HF at a level 3 dB above the low-frequency band NF, and is thus perceived primarily as a tone shifted through 11 Hz in the output signal, whereas the low-frequency band NF of the tone $d\#^3$ is significantly less perceptible. The beat frequencies occurring in the filter according to FIG. 3 can in this way be significantly reduced. The selection of the division frequency described is not restricted to the tones $d^3$ and $d\#^3$ mentioned here, but can be performed in an analogous manner for any arbitrary semitone step, i.e. two adjacent tones in the twelve-tone system.

Although the invention has been more closely illustrated and described in more detail through the preferred exemplary embodiment, the invention is not restricted by this exemplary embodiment. Other variations can be derived from this by the expert without leaving the scope of protection of the invention.

The following is a summary list of reference numerals and the corresponding structure used in the above description of the invention:

1 Method
2 Hearing aid
4 Input transducer
6 Sound signal
8 Input signal
10 Compensation signal
12 Electrical feedback loop
14 Error signal
16 Signal processing unit
18 Amplified audio signal
20 Frequency distortion
21 Frequency-distorted signal
22 Output signal
24 Output transducer
26 Output sound signal
28 Adaptive filter
30 Edge
32 Region below the division frequency
34 Region above the division frequency
$d^3$ Tone
$d\#^3$ Tone
f Frequency
f0 Possible division frequency
g Acoustic feedback
HF High-frequency band
NF Low-frequency band
S1 Method step
S2 Method step
S3 Method step
S4 Method step
S5 Method step
ST Method step/determination of the tonality
T Tonal system
tf0 Provisional division frequency
tf Division frequency

The invention claimed is:

1. A method for frequency distortion of an audio signal, which comprises the steps of:

dividing the audio signal at at least one division frequency into a low-frequency band and a high-frequency band;

generating a frequency-distorted signal through respectively different distortions of frequencies for the high-frequency band and for the low-frequency band; and selecting the division frequency in dependence on a given tonal system such that the division frequency is located between two neighboring tones of the given tonal system.

2. The method according to claim 1, wherein the given tonal system is given by a division of an octave, based on a predetermined reference tone, into $$\sqrt[12]{2}.$$

twelve tonal steps, each with a same frequency ratio.

3. The method according to claim 1, which further comprises shifting only the frequencies of the high-frequency band or only the frequencies of the low-frequency band by a constant amount for a distortion.

4. The method according to claim 1, which further comprises selecting the division frequency from a frequency interval that is located between the frequencies of the two neighboring tones of the tonal system in such a way that a lowest frequency and a highest frequency of the frequency interval are equidistant, or logarithmically equidistant, from the frequencies of the two neighboring tones.

5. The method according to claim 4, which further comprises selecting the division frequency at a geometric mean value of the frequencies of the two neighboring tones.

6. The method according to claim 1, which further comprises:

determining a frequency profile of the audio signal; and selecting the division frequency such that the audio signal exhibits a lowest possible signal energy at the division frequency.

7. The method according to claim 1, which further comprises:

determining a value for a tonality of the audio signal; and only selecting the division frequency such that the division frequency is located between the two neighboring tones of the given tonal system if the value for the tonality exceeds a predetermined limit value.

8. A method for suppressing an acoustic feedback in an acoustic system, which comprises:

generating, via an input transducer of the acoustic system, an input signal from a sound signal of an environment;

generating an intermediate signal via a signal processing unit on a basis of the input signal;

performing a method for frequency distortion of the intermediate signal, which comprises the steps of:

dividing the intermediated signal at at least one division frequency into a low-frequency band and a high-frequency band;

generating a frequency-distorted signal through respectively different distortions of frequencies for the high-frequency band and for the low-frequency band; and selecting the division frequency in dependence on a given tonal system such that the division frequency is located between two neighboring tones of the given tonal system;

generating an output signal from the frequency-distorted signal which is converted into an output sound signal by an output transducer of the acoustic system; and suppressing, on a basis of the frequency-distorted signal, an acoustic feedback occurring in the acoustic system through coupling the output sound signal into the input transducer.

9. The method according to claim 8, which further comprises:

selecting a provisional division frequency;

generating an estimation of a transfer function of the acoustic system for the high-frequency band in a region of the provisional division frequency;

selecting the at least one division frequency to be below the provisional division frequency when an estimated transfer function exceeds a permissible total amplification;

generating the frequency-distorted signal through a distortion of the frequencies of only the high-frequency band; and selecting the provisional division frequency such that the provisional division frequency lies between the two neighboring tones of the given tonal system.

10. A hearing aid, comprising:

an input transducer for generating an input signal from a sound signal of an environment;

a signal processing unit for generating an audio signal on a basis of the input signal; and a frequency distorter programmed to perform a method for frequency distortion of the audio signal, said frequency distorter programmed to:

divide the audio signal at at least one division frequency into a low-frequency band and a high-frequency band;

generate a frequency-distorted signal through respectively different distortions of frequencies for the high-frequency band and for the low-frequency band; and select the division frequency in dependence on a given tonal system such that the division frequency is located between two neighboring tones of the given tonal system.

11. A method for frequency distortion of an audio signal, which comprises the steps of:

dividing the audio signal at at least one division frequency into a low-frequency band and a high-frequency band;

generating a frequency-distorted signal through respectively different distortions of frequencies for the high-frequency band and for the low-frequency band;

selecting the division frequency such that the division frequency is located between two neighboring tones of a given tonal system;

selecting the division frequency from a frequency interval that is located between the frequencies of the two neighboring tones of the tonal system in such a way that a lowest frequency and a highest frequency of the frequency interval are equidistant, or logarithmically equidistant, from the frequencies of the two neighboring tones.

12. The method according to claim 11, which further comprises selecting the division frequency at a geometric mean value of the frequencies of the two neighboring tones.

13. A method for suppressing an acoustic feedback in an acoustic system, which comprises:

generating, via an input transducer of the acoustic system, an input signal from a sound signal of an environment;

generating an intermediate signal via a signal processing unit on a basis of the input signal;

performing a method for frequency distortion of the intermediate signal, which comprises the steps of:

dividing the intermediated signal at at least one division frequency into a low-frequency band and a high-frequency band;

generating a frequency-distorted signal through respectively different distortions of frequencies for the high-frequency band and for the low-frequency band; and selecting the division frequency such that the division frequency is located between two neighboring tones of a given tonal system;

generating an output signal from the frequency-distorted signal which is converted into an output sound signal by an output transducer of the acoustic system; and suppressing, on a basis of the frequency-distorted signal, an acoustic feedback occurring in the acoustic system through coupling the output sound signal into the input transducer;

selecting a provisional division frequency;

generating an estimation of a transfer function of the acoustic system for the high-frequency band in a region of the provisional division frequency;

selecting the at least one division frequency to be below the provisional division frequency when an estimated transfer function exceeds a permissible total amplification;

generating the frequency-distorted signal through a distortion of the frequencies of only the high-frequency band; and selecting the provisional division frequency such that the provisional division frequency lies between the two neighboring tones of the given tonal system.

* * * * *